United States Patent [19]

Kubek

[11] 4,455,050

[45] Jun. 19, 1984

[54] CLOT PREVENTING CHAIR AND ATTACHMENTS

[76] Inventor: John A. Kubek, 1938 Markham Dr., Bethlehem, Pa. 18017

[21] Appl. No.: 275,797

[22] Filed: Jun. 22, 1981

[51] Int. Cl.[3] ..... A47C 7/50

[52] U.S. Cl. ..... 297/430; 297/DIG. 4; 297/427; 297/464

[58] Field of Search ..... 297/430, 433, 427, 464, 297/DIG. 4, 437, 439, 431

[56] References Cited

U.S. PATENT DOCUMENTS

| | | | |
|---|---|---|---|
| 2,572,149 | 10/1951 | Hind et al. | 297/DIG. 4 |
| 2,591,911 | 4/1952 | Block | 297/437 X |
| 2,762,422 | 9/1956 | Stratton | 297/430 |
| 3,083,053 | 3/1963 | Dorsey | 297/430 X |
| 3,163,468 | 12/1964 | Koch | 297/439 |
| 3,249,388 | 5/1966 | Jennings | 297/427 X |
| 3,325,215 | 6/1967 | Murcott | 297/433 |
| 3,672,722 | 6/1972 | Murcott | 297/437 |
| 3,863,984 | 2/1975 | Sickles | 297/427 |
| 4,065,180 | 12/1977 | Karay | 297/DIG. 4 |

FOREIGN PATENT DOCUMENTS

| | | | |
|---|---|---|---|
| 474030 | 5/1951 | Canada | 297/431 |

*Primary Examiner*—James T. McCall
*Attorney, Agent, or Firm*—Ruth Moyerman

[57] ABSTRACT

A clot preventing invalid chair and attachments is disclosed in which a box-like single, open top foot enclosure is utilized to support both feet of a seated person. The enclosure attaches to the front and back chair legs in such a manner that it may be adjustable in both the horizontal and vertical planes and also pivot at the ankle to provide maximum comfort and adaptability. The box shoe structure prevents the patient's body from sliding forward and out of the chair, and also enables the patient's legs to be raised to prevent blood clots from forming, a condition prevalent in immobilized geriatric patients.

One embodiment contemplates telescoping braces to allow retraction of the foot rest and a second embodiment combines both the telescoping brace with a pivoting brace to permit the foot enclosure to be retracted and stored under the chair seat.

An auxiliary embodiment contemplates a knee support attachable to the arm rest of the chair to aid in keeping the legs aligned and to relieve pressure points where the knee of a patient could encounter the arm rest.

2 Claims, 6 Drawing Figures

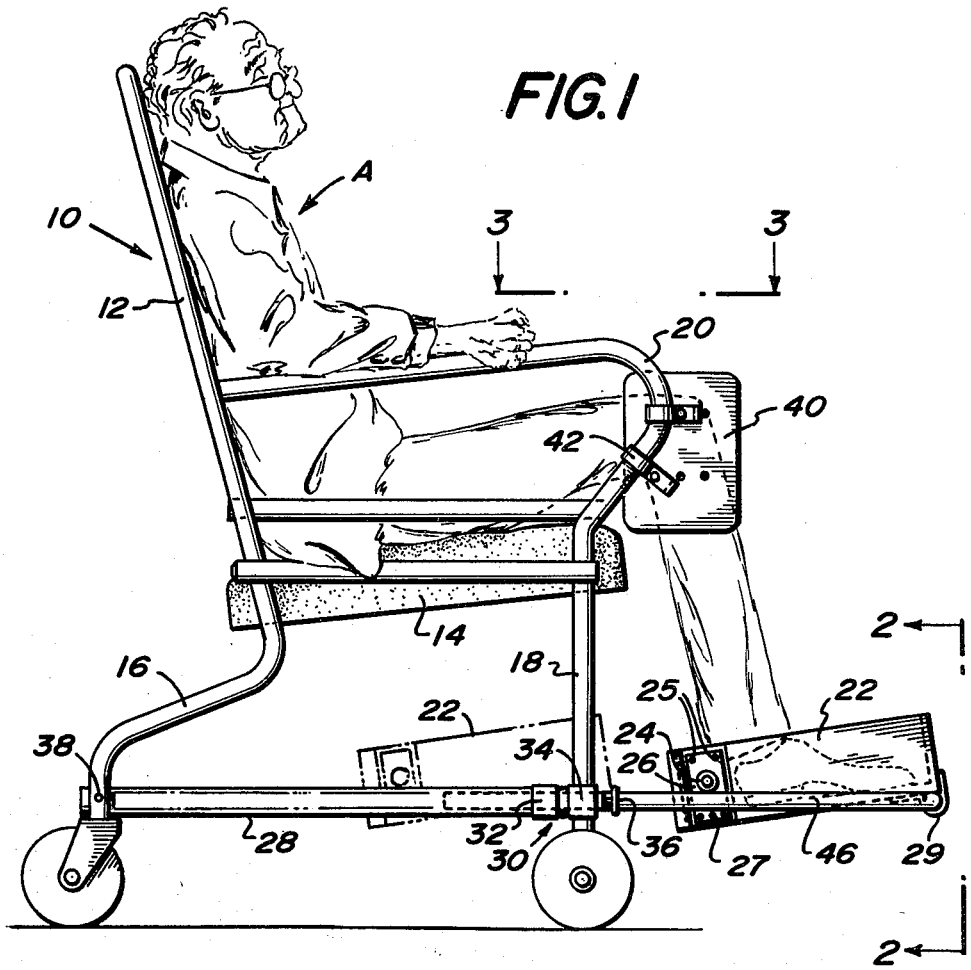
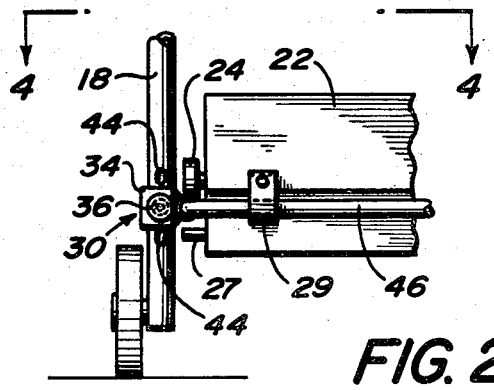
FIG. 2
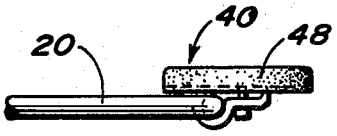
FIG. 3

CLOT PREVENTING CHAIR AND ATTACHMENTS

BACKGROUND OF THE INVENTION

1. Field of the Invention

This invention relate to chairs and seats, and more particularly to a rest for knee, leg or foot.

2. Description of the Prior Art

Blood clots, which develop frequently in the legs of the geriatric and immobilized people who are often confined to a wheel chair, are a recognized medical problem. The circulation of blood is poor among these patients and blood clot imfomation, particularly in the legs which, when freed up, can get into general circulation and into the lungs, is a serious problem. To improve circulation there is a need to, as much as possible, keep the thighs of such persons in an elevated position. This is known to improve circulation and therefore offer a reduced possibility of blood clots.

However, to keep the thighs of the elderly in an elevated position is not easily achieved because of several problems. First, geriatric wheelchair patients frequently have little use of the legs and feet and find it difficult to place their feet on a footstool or normal wheelchair footrest and also to keep them there against involuntary falling or slipping. Secondly, there is a propensity for the legs to fall opened at the knees causing the foot to tilt and the body to slide forward aggravating the poor circulation condition. Another problem relates to the need to have foot and leg rests totally adjustable to accommodate various body sizes and also to allow any single user to change position from time to time for his or her personal comfort.

Finally, the full weight of the body compresses the flesh of the thighs and their large veins so that clots of blood form in the thighs and legs. Parts of these clots break off and reach the lung's circulation, abruptly cutting off delivery of blood to segments of the lungs, often killing the patient immediately or causing a dangerous respiratory crisis.

There are some prior art devices which have recognized circulation problems such as U.S. Pat. No. 3,890,004 to Rail which proposes a chair-like structure with cushion support for the buttocks, thighs and lower limbs of a person seated in a cross-legged position.

There are also wheelchairs which include foot rests such as U.S. Pat. No. 3,672,722 to Murcott which discloses an adjustable combination seat and foot rest. However, the Murcott seat and foot rest, while it recognizes the need for adjustability, does not address itself to the problem of the lack of mobility of leg and foot, and the problem of knee separation and body forward slide with accompanying foot tilt which thereby negates the advantage of adjustability.

A second Murcott patent, U.S. No. 3,325,215 shows a retractable foot rest which, in use, is a "flip up". A third Murcott reference, U.S. Pat. No. 3,123,397 shows a "flip down" foot rest.

None of the aforementioned prior art references are truly suitable for the elderly, highly immobilized patient who chronically suffers from poor circulation, and for whom long hours in a wheelchair is the norm.

SUMMARY OF THE INVENTION

The aforementioned prior art problems are solved by the clot preventing chair and attachments of this invention in which provision is made to keep a patient or user's thighs elevated and the feet and knees aligned.

In this invention, a conventional invalid chair or wheel chair is fitted with a retractable foot support. The foot support comprises a single, open top, box-like enclosure adapted to receive both feet of a seated person. In this manner the feet are kept in place and aligned so that they do not slide forward, nor tilt to the side and cannot slip out, or fall out, of the support.

The support is designed so that it may be adjustably positioned in the vertical plane to allow the thighs to be raised at such angle as will improve circulation by removing pressure normally exerted by the seated weight of the person. Furthermore, the foot support is retractable or adjustable in the horizontal plane to allow it to be moved forward and backward for comfort and also for full retractability for storage underneath the chair.

An optional accessory, also part of this invention, to be utilized in combination with the foot support comprises a pair of knee supports which may be attached to conventional wheelchair arms and which include planar body-contacting surfaces which are designed to press against the legs of the user at the knee area to cause the knees to be body aligned and to discourage the propensity for the legs of some geriatric patients to fall apart, which condition contributes to reduced blood circulation and slipping forward out of the chair onto the floor.

It is therefore an object of this invention to provide a blood clot preventing chair including attachments which will provide both comfort and medical benefits to the sedentary or the invalid.

It is also an object of this invention to provide the aforesaid chair attachments which are adaptable to conventional geriatric chairs and the like.

It is also an object of this invention to provide knee, leg and foot support which is adjustable to various sizes of users within a single, adjustable embodiment.

It is yet another object of this invention to provide the aforesaid as a simple to use, readily adaptable, and inexpensive to produce attachment within the financial reach of the ordinary consumer.

These and other objects will be more readily ascertainable to those skilled in the art from a consideration of the accompanying drawings and detailed description of exemplary embodiments.

BRIEF DESCRIPTION OF THE DRAWINGS

FIG. 1 illustrates a preferred embodiment of the invention shown in use.

FIG. 2 shows a fragmentary view taken on lines 2—2 of FIG. 1.

FIG. 3 shows a fragmentary view taken on lines 3—3 of FIG. 1.

DETAILED DESCRIPTION OF THE PREFERRED EMBODIMENTS

Figure 5:
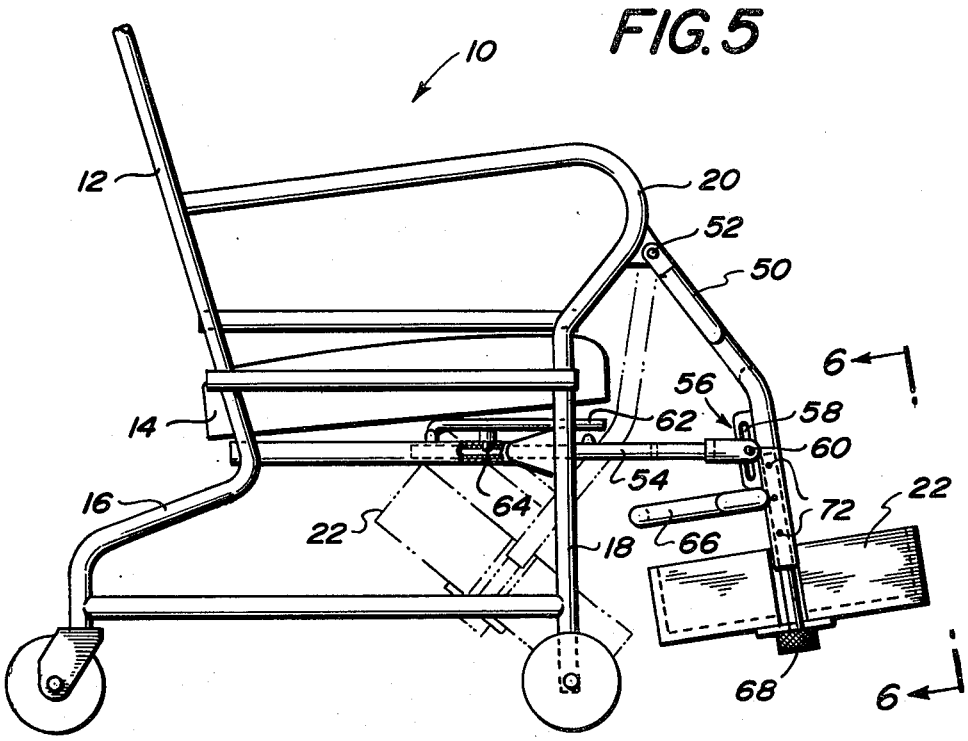
FIG. 5 illustrates an alternate embodiment of this invention.

Referring now to the drawings and more particularly to FIG. 1, a side view of the preferred embodiment of this invention is shown including invalid chair generally 10 in which a patient, A, is shown seated. Chair 10 includes conventional back 12, chair seat 14, back legs 16, front legs 18 and arm rests 20.

Supporting the feet of patient A is foot enclosure 22. Foot enclosure 22 is a single, open top foot enclosure adapted to receive and support both feet of patient A. Foot enclosure 22 includes on both its sides roller support 24 (one of the pair being shown in FIG. 1). Roller support 24 is mounted on plate 26, which is in turn mounted on foot enclosure 22. Roller support 24 rides on telescoping brace 28, which is again one of the pair of such telescoping braces positioned one on each side of chair 10. Guide 27 prevents roller 24 from being inadvertently lifted out of position.

Telescoping brace 28 (shown in the extended position and also in the retracted position in phantom) ends at its front end in hinge 29. Hinge 29 permits an angular adjustment of foot enclosure 22 through moving plate 26 upward or downward to accommodate the preference of patient A for differing foot angles. Plate 26 is held by screws 25 which fit into either a slot or a series of holes to make the adjustment. Telescoping brace 28 is connected to front leg 18 (again on both sides of the chair) by bracket 30. Bracket 30, in the preferred embodiment, includes flange 32 to which is attached clamp 34. Clamp 34 encircles leg 18 and includes spring loaded pin 36. The operation of pin 36 and bracket 30 will be explained in more detail in reference to FIG. 2.

Telescoping brace 28 is also pivotally attached at pin 38 to back leg 18, including extension 46 as a continuation.

FIG. 1 also shows a side view of one of a pair of knee supports 40, which in the preferred embodiment, are held by clamps 42 to arm rests 20.

Figure 4:
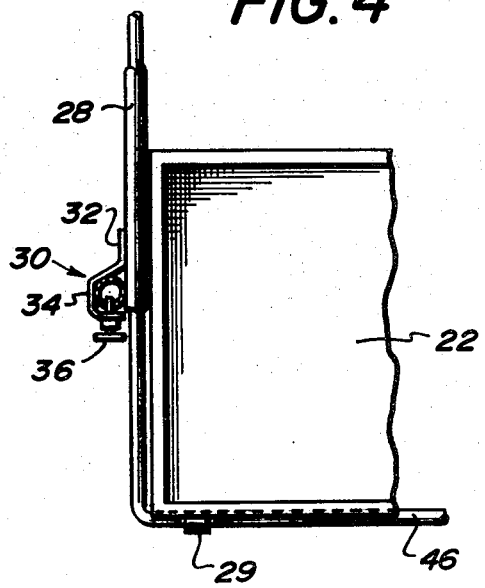
FIG. 4 shows a fragmentary view taken on lines 4—4 of FIG. 2.

Referring now to FIGS. 2, 3 and 4, details of the preferred embodiment are explained further. Referring now to FIG. 2, a partial section taken along lines 2—2 of FIG. 1 is shown. In this front view, front leg 18 is shown in a partial view including clamp 34 and pin 36. In the view shown in FIG. 2, aperatures 44 in front legs 18 are also visible. In operation, the user or nurse may adjust vertically the position of foot enclosure 22 so that the patient's legs are raised or lowered. To perform the adjustment, pin 36 is pulled, freeing it from aperature 44. A spring (not shown) tensions pin 36 while telescoping brace 28 may be slidably raised or lowered along front leg 18 through its pivot pin 38 on back leg 16. Release of the pin will cause it to pop into a new hole. Aperatures 44 may be either holes aligned offset (to allow for the shortened axis of the rising brace) along front leg 18, or the aperatures may be slightly slotted to achieve the same effect. Also in FIG. 2, hinge 29 may more clearly be seen engaging brace extension 46. Brace extension 46 is a continuation of telescoping brace 28.

Referring now to FIG. 3, a partial section taken on lines 3—3 of FIG. 1 shows knee support 40 from top view. Knee support 40 may include padded portion 48 to provide cushioning for the support. It is the purpose of knee pad 40 to cause a patient or user's knees to retain body alignment and not flop open. It is not uncommon in elderly patients that the knees part in this manner which causes the patient to slide forward in the chair and the ankles to roll. It is the purpose of the foot enclosure of this invention to prevent this forward slide of the feet and also the ankle roll associated with the falling open of the knees of the patient. Utilizing the foot enclosure with the knee support further enhances necessary body aligning and prevents the patient from sliding forward in the chair seat.

Referring now to FIG. 4, a section taken on lines 4—4 of FIG. 3 is shown. In this embodiment, a better view of the function of bracket 30 is visible. Flange 32, clamp 34 and spring pin 36 may be seen functioning in their relationship to telescoping brace 28.

Figure 6:
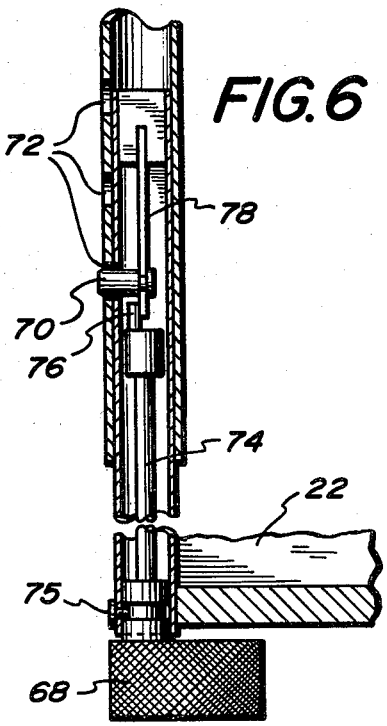
FIG. 6 shows a fragmentary view taken on lines 6—6 of FIG. 5.

Referring now to FIGS. 5 and 6, an alternate embodiment of the clot preventing invalid chair and attachments is shown. In the embodiment shown in FIG. 5, again invalid chair 10 is shown with chair back 12, chair seat 14, back legs 16, front legs 18 and arm rests 20. In the embodiment shown in FIG. 5, foot enclosure 22 is shown mounted on invalid chair 10 by a different means. In this embodiment, curved brace 50 supports at its one end foot enclosure 22 and its other end is attached to arm rest 20 at pivot pin 52. When not in use, foot enclosure 22 may be retracted (shown in phantom in FIG. 5) to its rest position under chair 10 by means of brace 54. Brace 54 is connected to curved brace 50 by coupling 56. Coupling 56, in the preferred embodiment, includes a slotted section 58 into which a pin 60 of brace 54 rides. To retract foot enclosure 22 for storage, a lever 62 is pulled slightly upward releasing pin 64 from a slot in brace 54 and permitting brace 54 to telescope into a closed position. It should be appreciated that curved brace 50, pivot pin 52, brace 54, coupling 56 and pin 64 are all one element of a pair of such elements, the other member of the pair being on the other front leg of chair 10. Lever 62 is U-shaped and in use the patient could reach down between his or her legs to catch hold of the spanning portion of the U-shaped lever to lift or lower it, performing the releasing and locking function. The embodiment shown in FIG. 5 also includes, optionally, horizontal brace 66, also U-shaped, and attached at each of its ends to one of the pairs of curved brace 50. The sole purpose of horizontal brace 66 is to strengthen the apparatus against accidental and undesirable torque.

Foot enclosure 22 may also be raised and lowered in the embodiment just described in FIG. 5 and referring now to FIG. 6, a detail taken on lines 6—6 of FIG. 5 shows in cross section the means by which foot enclosure 22 may be adjusted to accommodate taller or shorter users. Curved brace 50 ends in knurled knob 68. By turning knurled knob 68, pin 70 is caused to retract from aperature 72. This motion is accomplished because knurled knob 68 is attached to connecting rod 74 by set screw which in turn is connected to eccentric pin 76. Eccentric pin 76 causes leaf spring 78 to rotate slightly and thereby retract in a cam operation. By manually lifting or lowering foot enclosure 22 as knob 68 is turned, pin 70 will reposition itself in the various aperatures 72.

Having now described and illustrated my invention, it is not intended that such description limit this invention, but rather that this invention be limited only by a reasonable interpretation of the apended claims.

What is claimed is:

1. In an invalid chair of the type including a generally vertically back support, a generally horizontal seat, two arm rests and four legs, the improvement comprising:

(a) a box-like single, open top, foot enclosure adapted to receive and support both feet of a seated person, said enclosure being adjustable vertically to elevate knees and thighs off the chair seat, thereby releasing blood flow, and wherein said enclosure is pivotally mounted at its forward toe supporting end and vertically adjustable at its rear angle supporting end to allow a user's foot angular adjustment, said foot support also including, at its forward lower external edge, a box hinge to permit its pivot, and on each box side a vertically adjustable, mounted roller adapted to ride, one each on a telescopic brace;

(b) a pair of telescoping braces to allow said foot support to be retracted beneath said chair for storage, each said brace attached at its one end to said box enclosure and passing between said chair front legs to attach at said other end pivotally to said chair rear legs to allow said foot support to also be raised and lowered relative to the chair seat height;

(c) a pair of brackets attached, one to each of said telescoping braces, at a point on said brace adjacent the intersection of said brace and a corresponding chair front leg, said bracket including means to releasably attach said bracket to said leg; and, (d) a pair of knee supports cooperating with said foot support to hold said user's legs in body aligned position, each of said knee supports including a generally planar body contacting surface and bracket means, said bracket means adapted to releasably mount said supports, one on each of said chair arm rests so that when seated, a user's knees are urged together, thereby facilitating alignment of the user's feet in said foot support.

2. The invalid chair according to claim 1 wherein said brackets of step (c) each comprises a clamp to encircle said front chair leg, flanged at one end for permanent attachment to said brace and including spring loaded pin means at its other end, and wherein each of said front chair legs includes a series of apertures along its length into which said spring loaded pin may be inserted to thereby provide said bracketed clamping.

* * * * *